US006898945B1

(12) United States Patent
Grove

(10) Patent No.: US 6,898,945 B1
(45) Date of Patent: May 31, 2005

(54) MODULAR ADJUSTABLE NOZZLE AND DISTRIBUTOR ASSEMBLY FOR A REFRIGERATION SYSTEM

(75) Inventor: Bradley D. Grove, Flowery Branch, GA (US)

(73) Assignee: Heatcraft Refrigeration Products, LLC, Stone Mountain, GA (US)

( * ) Notice: Subject to any disclaimer, the term of this patent is extended or adjusted under 35 U.S.C. 154(b) by 0 days.

(21) Appl. No.: 10/740,270

(22) Filed: Dec. 18, 2003

(51) Int. Cl.[7] ..... F25B 5/00

(52) U.S. Cl. ..... 62/199; 62/524; 62/525; 62/528

(58) Field of Search ..... 62/199, 200, 524, 62/525, 527, 528; 137/528, 535, 540

(56) References Cited

U.S. PATENT DOCUMENTS

| | | | | | |
|---|---|---|---|---|---|
| 2,332,981 | A | * | 10/1943 | Anderson | 62/198 |
| 3,866,439 | A | * | 2/1975 | Bussjager et al. | 62/504 |
| 3,977,205 | A | * | 8/1976 | Dreisziger et al. | 62/117 |
| 4,089,368 | A | * | 5/1978 | Bell et al. | 165/139 |
| 4,412,432 | A | * | 11/1983 | Brendel | 62/504 |
| 4,543,802 | A | * | 10/1985 | Ingelmann et al. | 62/525 |
| 4,593,881 | A | | 6/1986 | Yoshino | |
| 4,835,976 | A | | 6/1989 | Torrence | |
| 4,969,628 | A | | 11/1990 | Reich et al. | |
| 4,976,404 | A | | 12/1990 | Ichikawa et al. | |
| 5,249,773 | A | | 10/1993 | Feld | |
| 5,364,066 | A | | 11/1994 | Dorste et al. | |
| 5,809,794 | A | | 9/1998 | Sibik | |
| 5,832,744 | A | * | 11/1998 | Dorste et al. | 62/528 |
| 5,842,351 | A | * | 12/1998 | Earhart, Jr. | 62/117 |
| 5,894,741 | A | * | 4/1999 | Durham et al. | 62/525 |
| 5,979,547 | A | * | 11/1999 | Shinmura et al. | 165/174 |
| 6,023,940 | A | * | 2/2000 | Abbott et al. | 62/504 |
| 6,309,208 | B1 | * | 10/2001 | Kazmer et al. | 425/562 |
| 6,381,974 | B1 | * | 5/2002 | Hwang et al. | 62/199 |

FOREIGN PATENT DOCUMENTS

| | | | |
|---|---|---|---|
| JP | 401263470 | A | * 10/1989 |
| JP | 402187582 | A | * 7/1990 |

* cited by examiner

*Primary Examiner*—William E. Tapolcai
*Assistant Examiner*—Mohammad M. Ali

(57) ABSTRACT

A refrigerant nozzle and distributor assembly for use with a refrigeration system having a plurality of evaporator circuits. The refrigerant nozzle and distributor assembly comprise a distributor body having an internal wall that divides the distributor body into an inlet portion and an outlet portion and an aperture having a central axis and formed in the internal wall between the inlet portion and the outlet portion. This embodiment further includes an adjustable pin that has first and second ends and a longitudinal axis substantially-coaxial with the central axis wherein the first end is configured to cooperate with the aperture. The adjustable pin and the aperture form a nozzle. A method of manufacturing a refrigerant nozzle and distributor assembly and a refrigeration system is also provided.

22 Claims, 6 Drawing Sheets

SIDE FEED

DOWN FEED

UP FEED

MODULAR ADJUSTABLE NOZZLE AND DISTRIBUTOR ASSEMBLY FOR A REFRIGERATION SYSTEM

TECHNICAL FIELD OF THE INVENTION

The present invention is directed, in general, to air conditioning/refrigeration systems and, more specifically, to a modular adjustable nozzle and refrigerant distribution assembly that equalizes refrigerant distributed to tubes feeding multiple evaporator circuits.

BACKGROUND OF THE INVENTION

Some refrigeration systems use a single compressor to serve a plurality of evaporator circuits, i.e., supermarket freezer and refrigerator sections, office building air conditioning, etc., where the cooling capability is distributed to the plurality of evaporator circuits. These systems require a refrigerant distributor assembly configured to properly apportion the cooling capacity of the refrigerant to the plurality of evaporator circuits. Ordinarily, refrigerant separates unevenly for two reasons. First, refrigerant is predominantly liquid by weight, but vapor occupies most of the volume, and second liquid and vapor flow at different velocities. FIGS. 1A–1C illustrate typical refrigerant flow for three common orientations of a system having a simple header, without benefit of a refrigerant distributor.

Today, refrigeration distributors use a fixed orifice that is pre-chosen when the system is designed. The orifice acts as a nozzle, creating a pressure drop across the nozzle and a turbulence in the refrigerant so that each of the plurality of evaporator circuits ideally receives a uniform amount of the refrigerant. The orifice size is chosen during design of the system using such factors as, type of refrigerant, size of the system, capacity of the system, or liquid temperature at the expansion valve, etc.

When multiple heat exchanger refrigeration systems are installed, a high percentage, but not all, of the installations have what can be considered to be the correct size orifice. Of course, that means that a fair percentage of installations do not have the proper size orifice. If the installed system is incorrect, i.e., the pressure drop across the nozzle is not as planned, the system must be opened, the distributor disassembled, and a new orifice installed to create a different pressure drop. This is both time consuming and costly. However, even if an orifice is correct for warm/hot summer conditions, when it is winter and the liquid temperature is significantly colder, a smaller orifice is needed but is not present. To partially compensate for these varying conditions, a very restrictive orifice is generally chosen at the higher summer temperature, and the system designer/installer hopes that the refrigerant feed to the plurality of evaporator circuits will be suitable during winter conditions. Furthermore, if a new refrigerant were to be made available or mandated, the system would have to be opened and a suitable orifice installed for the new refrigerant. The only other known refrigerant distributor uses an interior body sculpted to create turbulence in the distributor, and is not adjustable.

Accordingly, what is needed in the art is a distributor assembly that enables the distributor to be adjusted for changing conditions without opening the refrigeration system.

SUMMARY OF THE INVENTION

To address the above-discussed deficiencies of the prior art, the present invention provides a refrigerant nozzle and distributor assembly for use with a refrigeration system having a plurality of evaporator circuits. In one embodiment, the refrigerant nozzle and distributor assembly comprise a distributor body having an internal wall that divides the distributor body into an inlet portion and an outlet portion, and an aperture having a central axis is formed in the internal wall between the inlet portion and the outlet portion. This embodiment further includes an adjustable pin that has first and second ends and a longitudinal axis substantially-coaxial with the central axis wherein the first end is configured to cooperate with the aperture. The adjustable pin and the aperture form a nozzle. A method of manufacturing a refrigerant nozzle and distributor assembly and a refrigeration system is also provided.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1C:
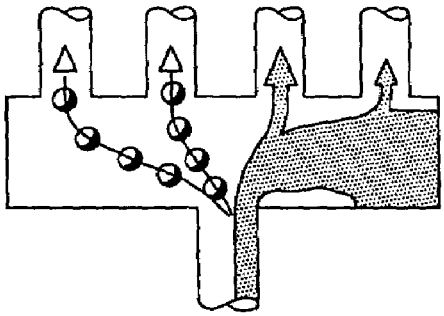
FIG. 1C (PRIOR ART)
FIG. 1C illustrates a conventional header system with a horizontal flow orientation.
Figure 1B:
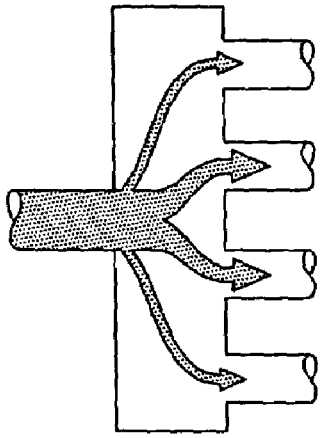
FIG. 1B (PRIOR ART)
FIG. 1B illustrates a conventional header system with a vertical downflow orientation.
Figure 1A:
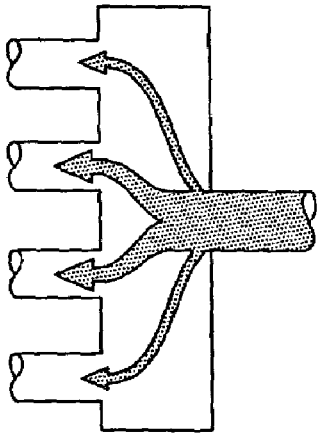
FIG. 1A (PRIOR ART)
FIG. 1A illustrates a conventional header system with a vertical upflow orientation.
Figure 2:
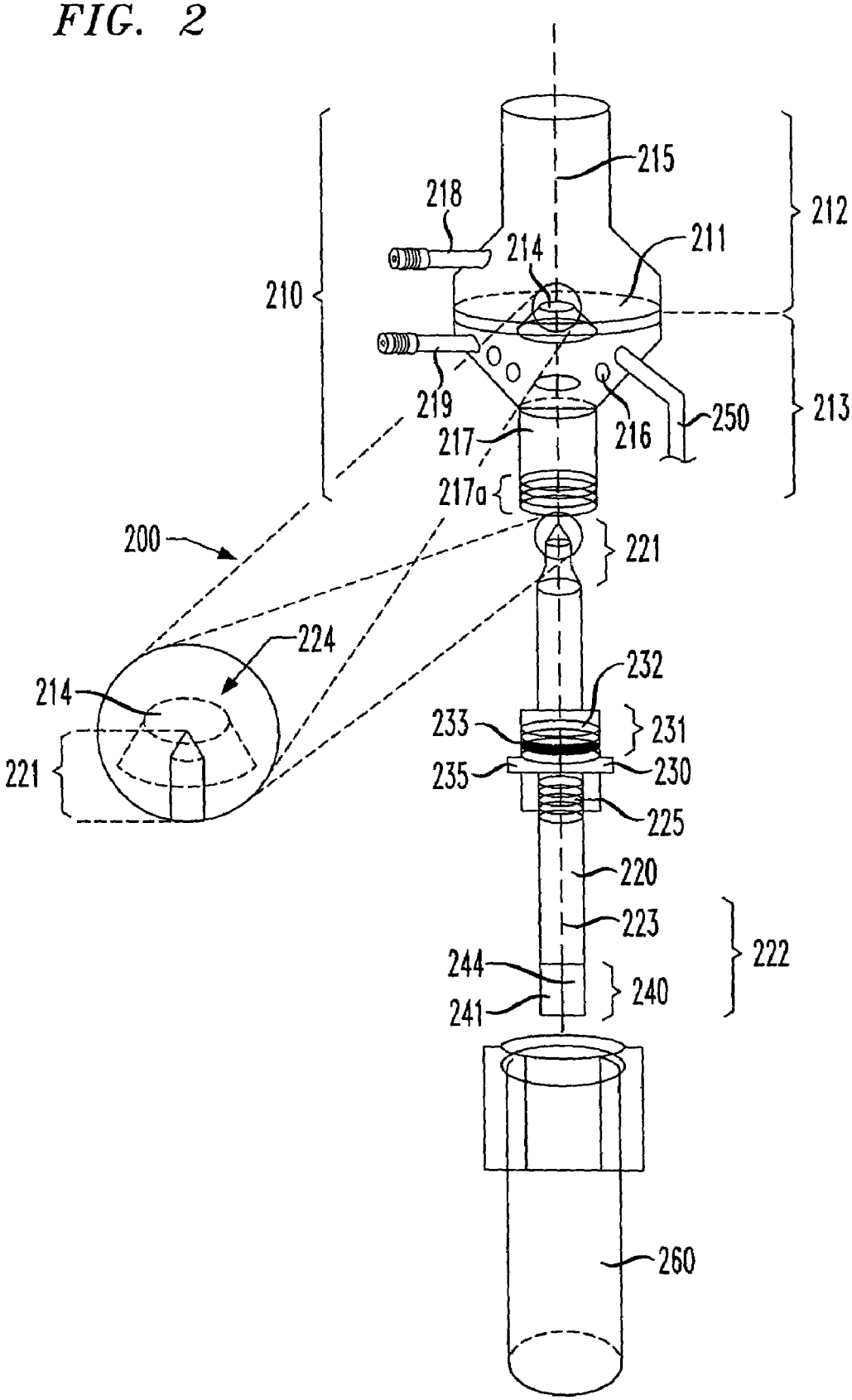
FIG. 2 illustrates an exploded, partial sectional view of one embodiment of a modular, manually-adjustable, refrigerant nozzle and distributor assembly.

Referring now to FIG. 2, illustrated is an exploded, partial sectional view of one embodiment of a modular, manually-adjustable, refrigerant nozzle and distributor assembly 200. The refrigerant nozzle and distributor assembly 200 (hereinafter referred to as the distributor 200) comprises a distributor body 210, an adjustable pin 220, a packing nut 230, a pin driver 240, and a cap 260. The distributor body 210 has an internal wall 211 that divides the distributor body 210 into an inlet portion 212 and an outlet portion 213. The internal wall 211 has an aperture 214 formed therethrough that allows fluid communication between the inlet portion 212 and the outlet portion 213. The aperture 214 has a central axis 215, and is, preferably, tapered (as shown in inset) from the outlet portion 213 of the distributor body 210 toward the inlet portion 212. A plurality of refrigerant distribution tubes 250 (only one shown for clarity) are coupled to a corresponding plurality of refrigerant distribution apertures 216 through the outlet portion 213. In this particular embodiment, the outlet portion 213 ends in a female threaded section 217 with female threads 217*a*.

Coupled to the distributor body 210 are first and second valves 218, 219, respectively. Preferably, the first and second valves 218, 219, are conventional Schrader valves that enable measuring system inlet pressure within the inlet portion 212 and system outlet pressure within the outlet portion 213, independently, without losing refrigerant to the atmosphere.

The packing nut 230 has male threads 231, female threads 232 and packing material 233. The male threads 231 are configured to cooperate with the female threads 217*a* of the female threaded section 217 in a knife-edge machine seal to install the adjustable pin 220 securely in the female threaded section 217. The packing material 233 is within the packing nut 230 and around a portion of the adjustable pin 220 and forms a seal between the adjustable pin 220 and the packing nut 230. One who is of skill in the art is familiar with the use of packing material around valve stems and would equally understand that the thread system might be reversed, or alternatively, a different coupling mechanism might be employed to replace the thread system.

The adjustable pin 220 has first and second ends 221, 222, respectively, a longitudinal axis 223, and external threads 225 along a portion of the adjustable pin 220. The first end 221 is configured to cooperate with the aperture 214 to form a nozzle 224. In a preferred embodiment, a portion of the first end 221 may be conical. However, the shape of the first end 221 may alternatively be any other shape, e.g., hemispherical, that will suitably cooperate with the aperture 214 to form the nozzle 224, wherein the nozzle 224 provides the necessary function of thoroughly mixing the liquid and gas of the refrigerant as will be described below.

A portion of the second end 222 is configured as the pin driver 240 in the illustrated embodiment. In the embodiment illustrated here, the pin driver 240 comprises four flat surfaces 241–244 (not all visible) on the second end 222, giving the pin driver 240 a square cross section. In this particular aspect, the pin driver 240 is configured to be driven with a manually operated open end or adjustable wrench (not shown). Turning the pin driver 240 with an open end or adjustable wrench advances or withdraws the adjustable pin 220 along the longitudinal axis 223 toward or away from the aperture 214. Of course, other end configurations of the manual pin driver 240, e.g., octagonal or hex end, slotted, Phillips, combination, Allen socket, Torx®, are suitable alternatives.

To adjust the adjustable nozzle 224, the cap 260 is removed and the plurality of distributor tubes 250 have been coupled to the distributor body 210 and to a corresponding plurality of evaporator circuits (not shown). To set the nozzle 224 for optimum pressure drop, a gauge set (not shown) is coupled to the inlet and outlet Schrader valves 218, 219, respectively. While observing the inlet and outlet pressures on the gauge set, the adjustable pin 220 may be manually adjusted by advancing or retarding until the desired pressure drop across the internal wall 211 is obtained. Additionally, one or more Schrader valves, similar to valves 218, 219, may be coupled at the inlet portion of the plurality of evaporator circuits. This will enable checking and setting the system for the total pressure drop from the inlet 212 of the distributor 210 to the inlet of one or more of the evaporator circuits. At that time, the manual tool used to adjust the adjustable pin 220 may be removed, and the cap 260 placed over the second end 222 until the cap 260 mates with the packing nut 230. The cap 260 may be configured as a friction fit on a rim 235 of the packing nut 230. Alternatively, the cap 260 may have female threads (not shown) that are configured to couple to male threads (not shown) on the rim 235. Of course other configurations of the cap 260 and packing nut 230/female threaded section 217 may be used as befits other configurations of mating the packing nut 230 and the female threaded section 217. Thus, the manually-adjustable, refrigerant nozzle and distributor assembly 200 can be readily accessed by a technician, as needed, to adjust the nozzle for optimum performance, i.e., a set pressure drop, as ambient temperature changes occur or other conditions change.

Figure 3:
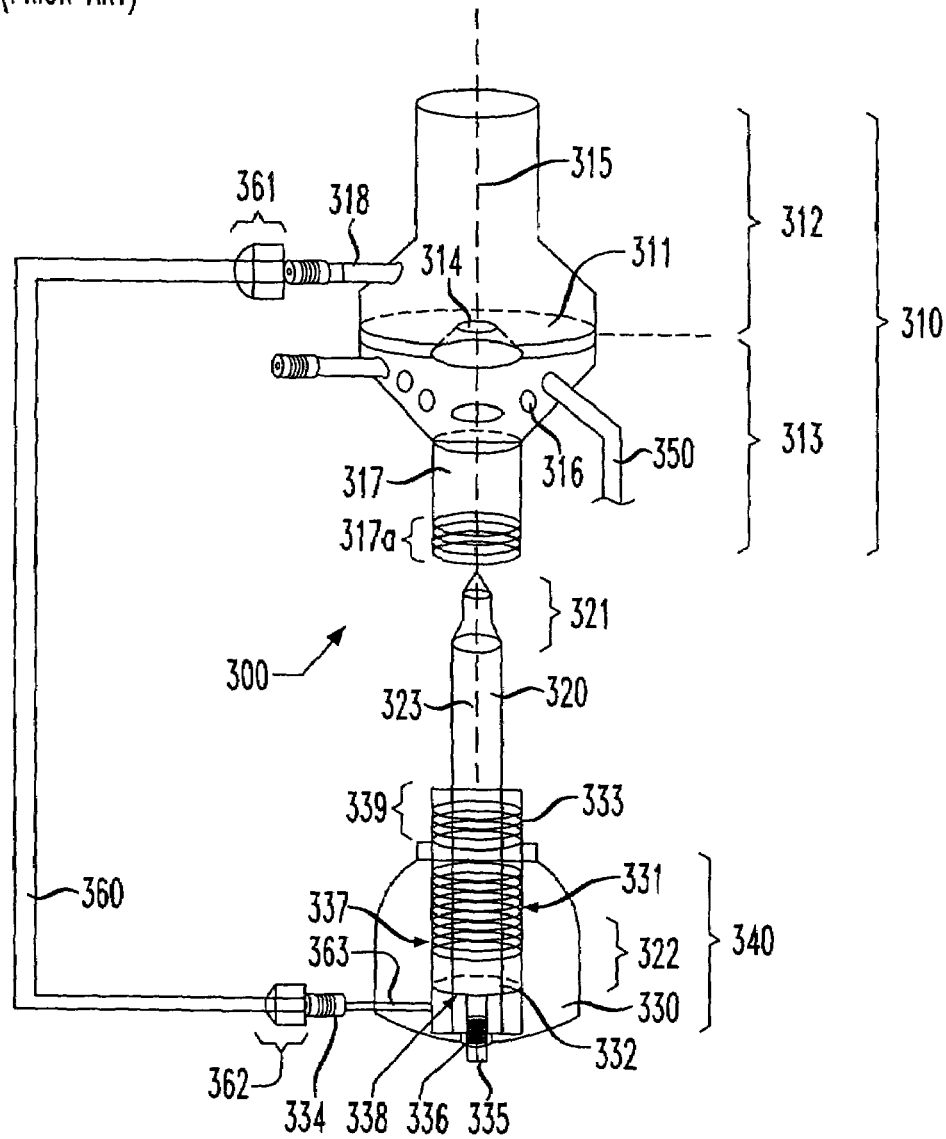
FIG. 3 (PRIOR ART)
FIG. 3 illustrates a partially exploded view of one embodiment of a modular, pressure-actuated, refrigerant nozzle and distributor assembly.

Referring now to FIG. 3, illustrated is a partially exploded view of another embodiment of the present invention. In this embodiment, the device is a modular, pressure-actuated, refrigerant nozzle and distributor assembly 300. The refrigerant nozzle and distributor assembly 300 (distributor 300) has several elements that are analogous or identical to elements of the distributor assembly 200 of FIG. 2. The analogous elements are: a distributor body 310, an adjustable pin 320, and a pin driver 340. Analogous elements within or coupled to the distributor body 310 are: an internal wall 311, an inlet portion 312, an outlet portion 313, an aperture 314 having a central axis 315, an inlet valve 318, a plurality of refrigerant distribution tubes 350 (only one shown), a corresponding plurality of refrigerant distribution apertures 316, a female threaded section 317 with female threads 317*a*. The adjustable pin 320 has a first end 321 and a second end 322. The illustrated embodiment 300 further comprises: a valve housing 330, a valve tube 331, a piston 332, a spring 333, an actuator valve 334, an adjustment screw 335, a seal 336, and an inlet pressure line 360. The inlet valve 318 and the actuator valve 334 may be conventional Schrader valves. The adjustable pin 320 has a longitudinal axis 323.

In one embodiment, the piston 332 is located around and coupled to the adjustable pin 320 proximate the second end 322. The piston 332 has a first face 337 oriented toward the first end 321, and a second face 338 opposing the first face 321. In the illustrated embodiment, the spring 333 is a coil spring 333 located around the adjustable pin 320 proximate the first end 321 and captured between the first face 337 of the piston 332 and the outlet portion 313. Of course, other configurations of the spring 333 may also be used. The adjustable pin 320, piston 332, and spring 333 are located within the valve tube 331 which is concentric with the longitudinal axis 323. The valve housing 330 couples to the distributor body 310 by threading a male threaded portion 339 to the female threaded section 317 in such a manner that the adjustable pin 320 slides along the longitudinal axis 323 within the valve tube 331. Of course, other forms of coupling the valve housing 330 to the distributor body 310 may also be used. Force exerted by the coil spring 333 on the first face 337 is adjustable by screwing adjustment screw 335 in or out of the valve housing 330.

The actuator valve 334 is coupled through the valve housing 330 via tube 363 to the valve tube 331 proximate the second face 338. A first end 361 of the inlet pressure line 360 is coupled to the inlet valve 318 and a second end 362 is coupled to the actuator valve 334 thereby equalizing inlet pressure in the inlet portion 312 and pressure on the second face 338 of the piston 332. Outlet pressure within the outlet portion 313 is communicated via the female threaded section 317 and the valve tube 331 to the first face 337 of the piston 332. Outlet pressure in the outlet portion 313 and on the first face 337 will generally be less than any inlet pressure in the inlet portion 312 and on the second face 338, while the coil spring 333 exerts a force on the first face 337 is adjustable with the adjustment screw 335. Therefore, outlet pressure plus the spring force on the first face 337 will automatically adjust to changing inlet pressure on the second face 338, thereby maintaining a substantially-constant pressure drop across the internal wall 311 as conditions change.

Figure 4A:
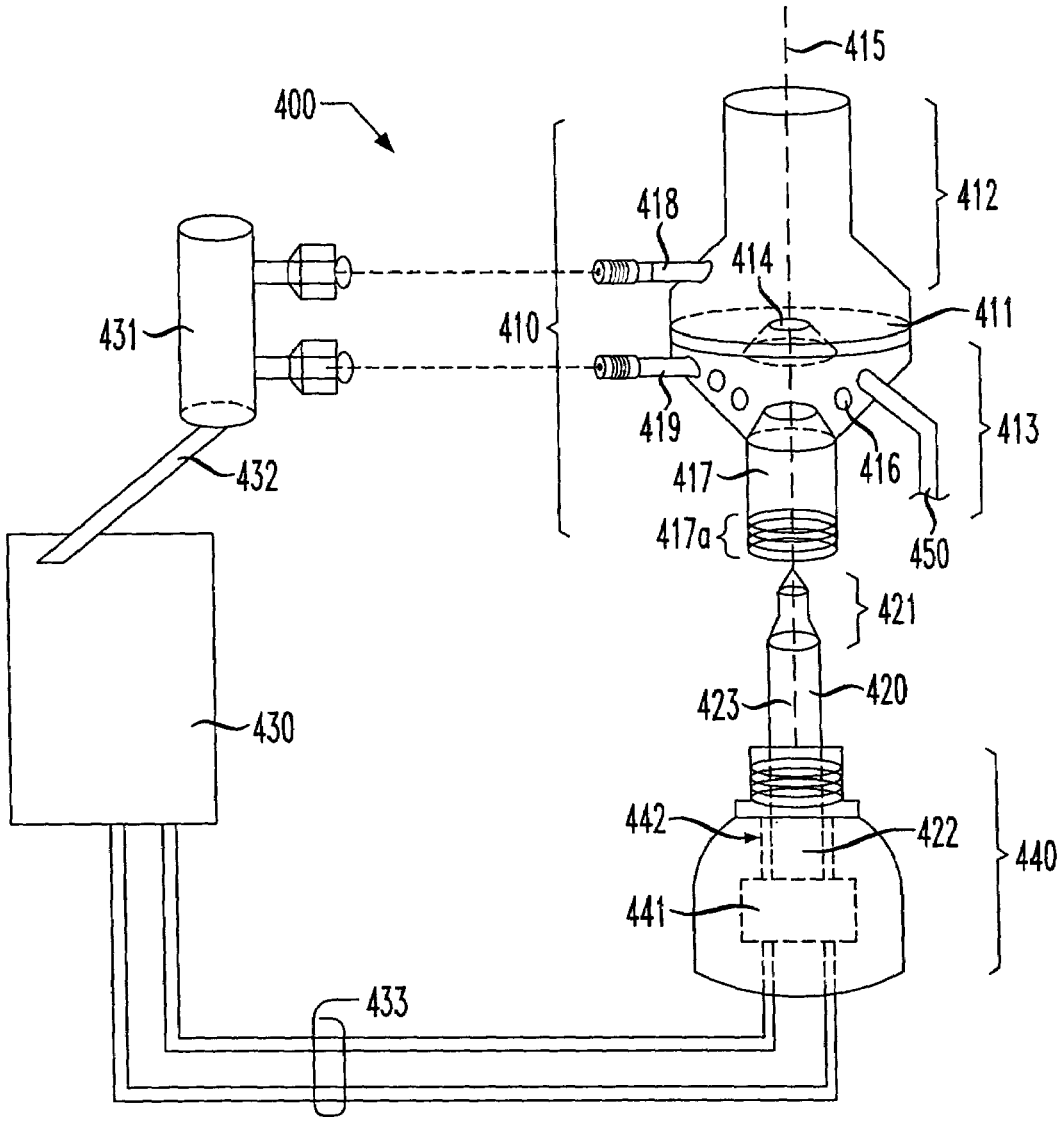
FIG. 4A illustrates a partially exploded view of one embodiment of a modular, stepper motor-actuated, refrigerant nozzle and distributor assembly.

Referring now to FIG. 4A, illustrated is a partially-exploded view of another embodiment wherein the device is a modular, stepper motor-actuated, refrigerant nozzle and distributor assembly 400. As with the refrigerant nozzle and distributor assembly 300 of FIG. 3, the distributor 400 has several elements that are analogous or identical to elements of the distributor assembly 200 of FIGS. 2A and 2B. The analogous elements are: a distributor body 410, an adjustable pin 420, and a pin driver 440. Analogous elements within or coupled to the distributor body 410 are: an internal wall 411, an inlet portion 412, an outlet portion 413, an aperture 414 having a central axis 415, an inlet valve 418, an outlet valve 419, a plurality of refrigerant distribution tubes 450 (only one shown), a corresponding plurality of refrigerant distribution apertures 416, a female threaded section 417 with female threads 417*a*. The adjustable pin 420 has a first end 421, a second end 422, and a longitudinal axis 423. The illustrated embodiment 400 further comprises: a stepper motor 441, an electronics board 430, a pressure transducer 431, a wire harness 432, and a motor wire harness 433. The inlet and outlet valves, 418, 419, respectively, may be conventional Schrader valves.

In one embodiment, the pressure transducer 431 is a differential pressure transducer 431 and is coupled to the inlet and outlet valves 418, 419, respectively. The pressure transducer 431 is coupled to the electronics board 430 with wire harness 432, and the electronics board 430 is coupled to the stepper motor 441 with motor wire harness 433. The stepper motor 441 is housed within a pin driver housing 442 and coupled to the second end 422 of the adjustable pin 420. The stepper motor 441 and the adjustable pin 420 are configured to advance or retard the position of the adjustable pin 420 along the longitudinal axis 423. The stepper motor's 441 configuration and operation may be similar to a stepper motor used for controlling a needle valve position. In this configuration, the differential pressure transducer 431 compares the pressure in the inlet portion 412 (inlet pressure) and the pressure in the outlet portion 413 (outlet pressure) and determines a differential pressure. That resultant differential pressure is communicated to the electronics board 430 by wire harness 432. The electronics board 430 compares the resultant differential to a pre-determined pressure drop between the inlet portion 412 and the outlet portion 413 and, if there is a difference between the two values, the electronics board 430 communicates a command by way of the motor wire harness 433 to the stepper motor 441 to adjust the adjustable pin 420 appropriately.

Figure 4B:
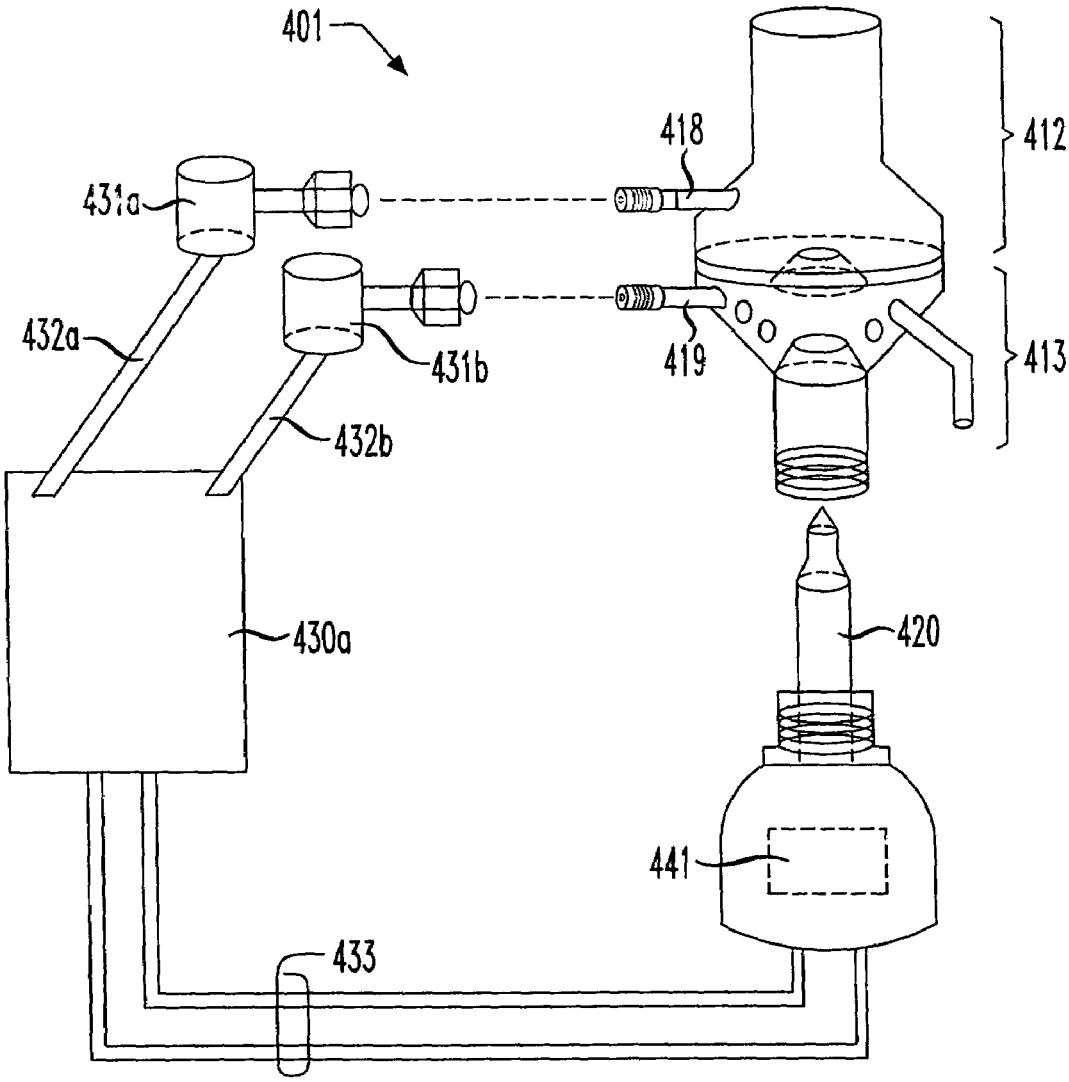
FIG. 4B illustrates an alternative embodiment of the modular, stepper motor-actuated, refrigerant nozzle and distributor assembly of FIG. 4A.

Referring now to FIG. 4B, illustrated is an alternative embodiment 401 of the modular, stepper motor-actuated, refrigerant nozzle and distributor assembly 400 of FIG. 4A. In this embodiment, the pressure transducer 431 of FIG. 4A is first and second pressure transducers 431*a*, 431*b* and are coupled to the inlet and outlet valves 418, 419, respectively. Pressure transducers 431*a*, 431*b* are coupled to an electronics board 430*a* with wire harnesses 432*a*, 432*b*, respectively. The electronics board 430*a*, stepper motor 441, motor wire harness 433, and adjustable pin 420 are coupled as in the distributor 400 of FIG. 4. In this configuration, the pressure transducers 431*a*, 431*b* communicate individual inlet and outlet pressures, respectively, to the electronics board 430*a* by wire harnesses 432*a*, 432*b*. The electronics board 430*a* computes a differential pressure between the inlet and outlet pressures and compares the resultant differential to the pre-determined pressure drop between the inlet portion 412 and the outlet portion 413 and, if there is a difference between the two values, the electronics board 430*a* communicates a command by way of the motor wire harness 433 to the stepper motor 441 to adjust the adjustable pin 420 appropriately. Of course, the added enhancement of one or more Schrader valves, similar to valves 418, 419, may be coupled at the inlet portion of the plurality of evaporator coils (not shown) in either embodiment of FIG. 4A or 4B. This will enable checking and setting the system for the total pressure drop from the inlet 412 of the distributor 410 to the inlet of one or more of the evaporator coils.

Figure 5:
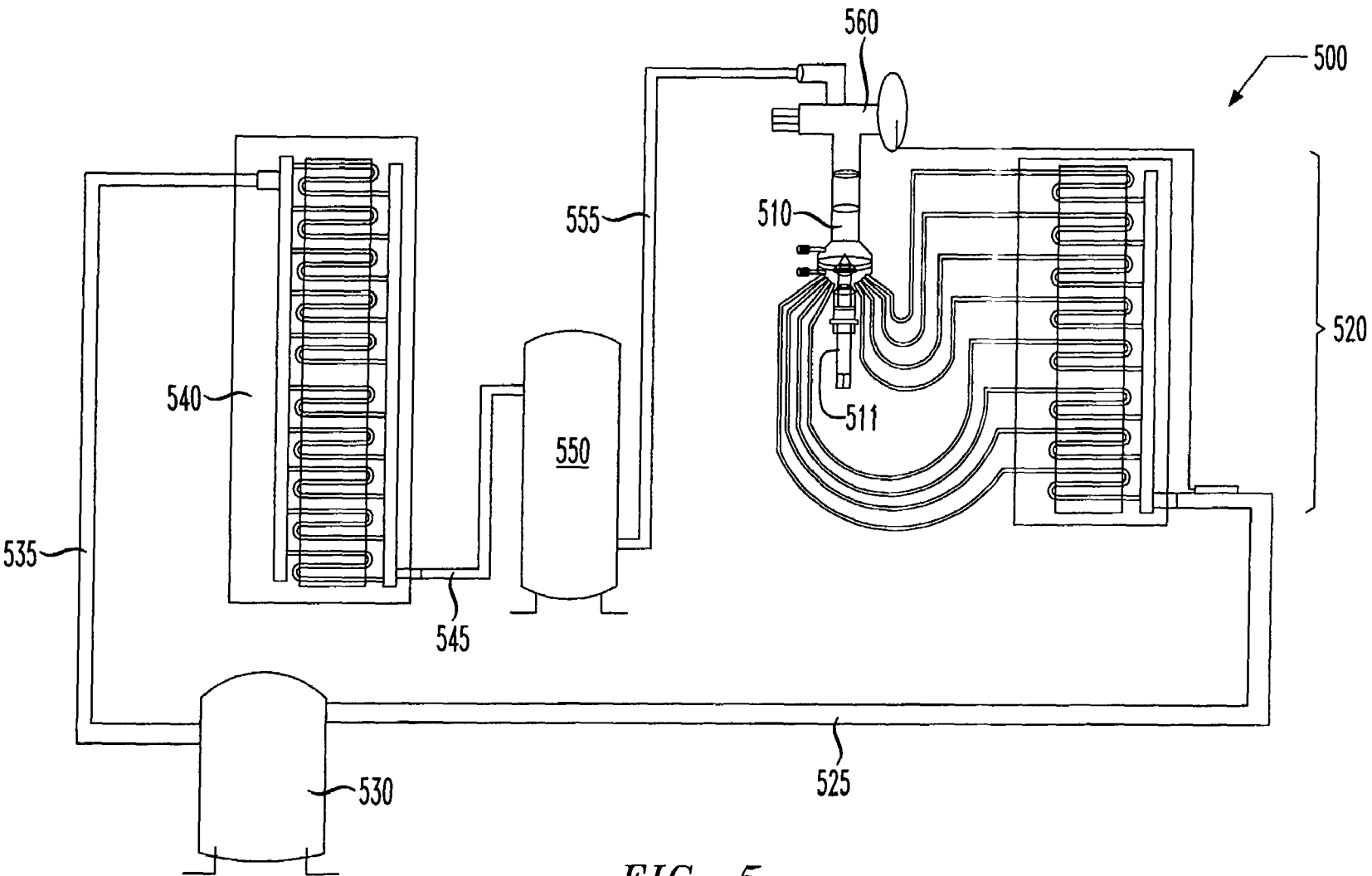
FIG. 5 illustrates an air conditioning system, which may be commercial or multi-residential in nature, comprising a modular, adjustable refrigerant nozzle and distributor assembly constructed according to the present invention and a plurality of evaporator circuits.

Referring now to FIG. 5, illustrated is a refrigeration/air conditioning system 500, which may be commercial or multi-residential in nature, comprising a modular, adjustable refrigerant nozzle and distributor assembly 510 constructed according to the present invention and a plurality of evaporator circuits 520. The refrigeration/air conditioning system 500 may also be referred to as a vapor compression system 500 as the components of each are analogous or similar. The refrigeration/air conditioning system 500 further comprises a compressor 530, a condenser 540, a receiver 550, and an expansion valve 560. The compressor 530 is coupled to the condenser 540 by a discharge line 535. The receiver is coupled to the condenser 540 by a liquid line 545. The expansion valve 560 is coupled to the receiver 550 by a liquid line 555. The adjustable distributor assembly 510 is directly coupled downstream to the expansion valve 560. A plurality of distributor tubes 515 couple the distributor assembly 510 to the plurality of evaporator circuits 520. A suction line 525 couples the outlets of the plurality of evaporator circuits 520 to the inlet of compressor 530, completing a closed system.

The adjustable distributor assembly 510 shown is the manually adjustable distributor assembly 200 of FIG. 2 and having an adjustable pin 511. However, one who is skilled in the art will recognize that the embodiments of FIGS. 3, 4A or 4B can likewise be employed on this system, the only difference being the manner in which the adjustable pin 511 is positioned.

Thus, a modular, adjustable refrigerant nozzle and distributor assembly has been described that enables adjustment of the nozzle to achieve a pre-determined pressure drop across an internal wall of the distributor without opening the system. The distributor body is common to all embodiments in such a manner that the drive mechanism for the adjustable pin of the assembly may be interchanged.

Although the present invention has been described in detail, those skilled in the art should understand that they can make various changes, substitutions and alterations herein without departing from the spirit and scope of the invention in its broadest form.

What is claimed is:

1. For use with a refrigeration system having a plurality of evaporator circuits, a refrigerant nozzle and distributor assembly, comprising:

a distributor body having an internal wall dividing said distributor body into an inlet portion and an outlet portion;

an aperture having a central axis and formed in said internal wall between said inlet portion and said outlet portion;

an adjustable pin having first and second ends and a longitudinal axis substantially-coaxial with said central axis, said first end configured to cooperate with said aperture to form a nozzle; and a pin driver coupled to said second end and including a packing nut coupleable to said outlet portion, said packing nut having female threads therethrough, and wherein said adjustable pin has complementary male threads formed thereon, said female threads and said male threads configured to adjust said adjustable pin along said longitudinal axis.

2. The refrigerant nozzle and distributor assembly as recited in claim 1 further comprising a packing seal interposed said packing nut and said adjustable pin.

3. The refrigerant nozzle and distributor assembly as recited in claim 1 wherein said pin driver is a manual pin driver.

4. The refrigerant nozzle and distributor assembly as recited in claim 1 wherein said pin driver includes a piston coupled to said second end of said adjustable pin.

5. The refrigerant nozzle and distributor assembly as recited in claim 4 wherein said piston has a first face oriented toward said adjustable pin and a second face opposing said first face and further comprising a pressure tube coupled between said inlet valve and said second face.

6. The refrigerant nozzle and distributor assembly as recited in claim 5 further comprising a coil spring captured between said first face and said outlet portion, and wherein said pin driver is a pressure-actuated pin driver.

7. The refrigerant nozzle and distributor assembly as recited in claim 6 further comprising an adjustment screw coupled to said adjustable pin proximate said second end and wherein a force exerted by said coil spring on said first face is adjustable with said adjustment screw.

8. The refrigerant nozzle and distributor assembly as recited in claim 1 further comprising:

an inlet valve coupled to said inlet portion and configured to access an inlet pressure within said inlet portion; and an outlet valve coupled to said outlet portion and configured to access an outlet pressure within said outlet portion, and wherein a pressure drop is calculated as said inlet pressure minus said outlet pressure.

9. The refrigerant nozzle and distributor assembly as recited in claim 8 further comprising a control board coupled to:

said inlet valve, said outlet valve, and said pin driver, and wherein said control board is configured to:

sense said inlet pressure and said outlet pressure, and adjust said pin driver so as to maintain a constant pressure drop.

10. The refrigerant nozzle and distributor assembly as recited in claim 9 further comprising a stepper motor coupled to said control board and said adjustable pin, and wherein said pin driver is a stepper motor-actuated pin driver.

11. A method of manufacturing a refrigerant nozzle and distributor assembly for use with a refrigeration system having a plurality of evaporator circuits, comprising:

forming a distributor body having an internal wall dividing said distributor body into an inlet portion and an outlet portion;

forming an aperture having a central axis in said internal wall between said inlet portion and said outlet portion;

locating an adjustable pin having first and second ends and a longitudinal axis substantially-coaxial with said central axis, said first end configured to cooperate with said aperture, said adjustable pin and said aperture forming a nozzle;

coupling a packing nut to said outlet portion, said packing nut having female threads therethrough, and wherein said adjustable pin has complementary male threads formed thereon; and coupling a pin driver to said second end and configuring said pin driver to adjust said adjustable pin along said longitudinal axis using said complementary male and female threads.

12. The method as recited in claim 11 further comprising interposing a packing seal between said packing nut and said adjustable pin.

13. The method as recited in claim 11 wherein said pin driver is a manual pin driver.

14. The method as recited in claim 11 further comprising coupling a piston to said second end of said adjustable.

15. The method as recited in claim 14 wherein said piston has a first face oriented toward said adjustable pin and a second face opposing said first face and further comprising coupling a pressure tube between said inlet valve and said second face.

16. The method as recited in claim 14 further comprising capturing a coil spring between said first face and said outlet portion, and wherein said pin driver is a pressure-actuated pin driver.

17. The method as recited in claim 14 further comprising coupling an adjustment screw to said adjustable pin proximate said second end, and wherein a force exerted by said coil spring on said first face is adjustable with said adjustment screw.

18. The method as recited in claim 11 further comprising:

coupling an inlet valve to said inlet portion and configured to access an inlet pressure within said inlet portion; and coupling an outlet valve to said outlet portion and configured to access an outlet pressure within said outlet portion, and wherein a pressure drop is calculated as said inlet pressure minus said outlet pressure.

19. The method as recited in claim 17 further comprising coupling a control board to:

said inlet valve, said outlet valve, and said pin driver; and configuring said control board to:

sense said inlet pressure and said outlet pressure, and adjust said pin driver so as to maintain a constant pressure drop.

20. The method as recited in claim 18 further comprising coupling a stepper motor to said control board and said adjustable pin, and wherein said pin driver is a stepper motor-actuated pin driver.

21. A refrigeration system, comprising:

a condenser having a condenser inlet and a condenser outlet;

an expansion valve coupled to said condenser outlet;

a refrigerant nozzle and distributor assembly coupled to said expansion valve, said refrigerant nozzle and distributor assembly including:

a distributor body having an internal wall dividing said distributor body into an inlet portion and an outlet portion;

an aperture having a central axis and formed in said internal wall between said inlet portion and said outlet portion; and an adjustable pin having first and second ends and a longitudinal axis substantially-coaxial with said central axis, said first end configured to cooperate with said aperture to form a nozzle;

a pin driver coupled to said second end and including a packing nut coupleable to said outlet portion, said packing nut having female threads therethrough, and wherein said adjustable pin has complementary male threads formed thereon, said complementary male and female threads configured to enable said pin driver to adjust said adjustable pin along said longitudinal axis; and a plurality of evaporator circuits coupled to said refrigerant nozzle and distributor assembly.

22. The refrigeration system as recited in claim 21 further comprising an adjustment means coupled to said adjustable pin and configured to adjust said adjustable pin along said longitudinal axis.

* * * * *